United States Patent [19]

Lashta

[11] Patent Number: 4,949,757

[45] Date of Patent: Aug. 21, 1990

[54] HYDRAULIC CONTROL SYSTEM

[76] Inventor: Steve Lashta, Post Office Box 263, Yorkton, Saskatchewan, Canada, S3N 2V7

[21] Appl. No.: 442,409

[22] Filed: Nov. 28, 1988

Related U.S. Application Data

[63] Continuation of Ser. No. 173,242, Mar. 24, 1988, abandoned.

[51] Int. Cl.[5] ..... G16K 31/02

[52] U.S. Cl. ..... 137/884; 91/527; 137/596.17

[58] Field of Search ..... 137/884, 614.06, 596, 137/596.17; 91/527, 530

[56] References Cited

U.S. PATENT DOCUMENTS

| | | | |
|---|---|---|---|
| 2,247,140 | 6/1941 | Twyman | 137/884 X |
| 2,453,741 | 11/1948 | Bopp | 137/614.04 X |
| 3,111,139 | 11/1963 | Beckett et al. | 137/884 |
| 3,512,453 | 5/1970 | Balzer | 91/527 x |
| 3,550,621 | 12/1970 | Lansky | 137/884 |
| 3,556,147 | 1/1971 | Sizer et al. | 137/884 |
| 4,186,771 | 2/1980 | Matsumoto | 137/596.17 |
| 4,492,148 | 1/1985 | Kuromoto | 91/527 X |

*Primary Examiner*—John C. Fox

[57] ABSTRACT

This system is a multiple hydraulic control unit to be quick coupled to any existing hydraulic system on a machine or tractor that has male or female breakaway couplers, and a flow control valve. This multiple hydraulic control arrangement can be easily transported from one hydraulic power unit to another, such as a farm or garden tractor, simply by uncoupling the hose connections and wiring harness, then connecting them into another power source. The electric components of this system consist of; 12, 24, or 120 volt solinoids, a control handle, or control box, which are placed within easy reach of the operator. Then the operator selects which selector valve is to be used by depressing one of the momentary switches installed into the handle or control box. When the selector valve is selected, the operator controls the oil flow with the existing permanently installed control valve. This arrangement can have as many selectro valves as the operator requires, simply by staking the vlaves in parallel and attaching more electrical switches.

8 Claims, 1 Drawing Sheet

HYDRAULIC CONTROL SYSTEM

This application is a continuation of application Ser. No. 173,242, filed Mar. 24, 1988, now abandoned.

FIELD OF THE INVENTION

The present invention relates to hydraulic power systems and more particularly to the conversion of a single outlet hydraulic power system to a multiple outlet system.

BACKGROUND

In tractors and other equipment with hydraulic power systems for operating auxiliary units, it is frequently desirable to provide more outlets for the hydraulic system than those with which the original equipment was supplied. Conventionally, this involves plumbing in one or more additional hydraulic circuits, including extra hydraulic lines and control valves at the operator's station, e.g. in the cab of a tractor. The conversion is time consuming and costly and the potential leak points are multiplied.

SUMMARY

The present invention is concerned with the provision of an alternative system for multiplying single hydraulic outlets to provide plural outlets.

According to the present invention there is provided a kit for converting a single outlet hydraulic system to a plural outlet system, said kit comprising:

a plurality of valves, each having an inlet and an outlet, valving means operatively connected between the inlet and outlet and having valve open and valve closed conditions, respectively opening and closely communication between the outlet and the inlet, and actuator means operatively associated with the valving means for selectively actuating the valving means into the valve open and valve closed conditions;

valve inlet coupling means coupling the inlets of the valves for fluid communication therebetween;

a control module including a plurality of manually operable controls;

control circuit means connecting each valve actuator means to a respective manually operable control for selective operation of the acutuator means in response to operation of the control; and means for mounting the control module at an operator's station remote from the valves.

The valve inlets can be coupled to a single system outlet to provide multiple outlets that are selectively actuable. The control for the system outlet then control whichever outlets are selected by the operator using the control module.

In one preferred form, the control module is a control handle that mounts on a flow control lever at the operator's station. The handle has a number of switches spaced along it for actuation by an operator's fingers. This allows an operator to select the outlet to be powered then simultaneously to control the flow to that outlet.

An alternative embodiment of the control module is a housing with on-off switches for each valve actuator, and indicator lights for indicating which valves are open.

The valves may be stacked valves, coupled in a unit, with the inlets in direct communication with one another. With such an arrangement, the multiple outlet system can be treated as a unit that connects to the single outlet system with quick release couplings so that it can be transferred from one piece of equipment to another as required.

BRIEF DESCRIPTION OF THE DRAWINGS

In the accompanying drawings, which illustrate exemplary embodiments of the present invention.

DETAILED DESCRIPTION

Figure 4:
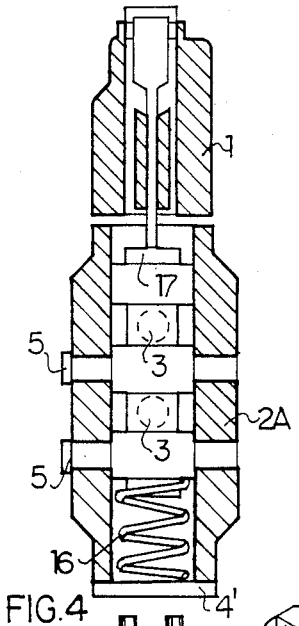
FIG. 4 is a cross-sectional elevation of a valve.
Figure 1:
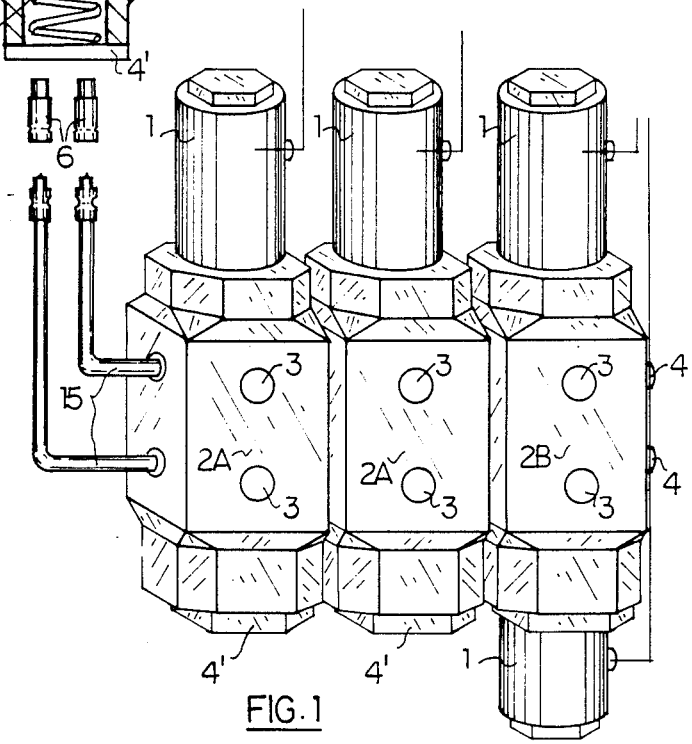
FIG. 1 is an isometric representation of a set of stacked valves.

Referring to the accompanying drawings, FIG. 1 illustrates a valve assembly consisting of three hydraulic selector valves 2A, 2A and 2B. Each valve is a two-way, two-position valve constructed generally as illustrated in FIG. 4. The valve has a valve body with an inlet including a pair of inlet ports 5, and an outlet including a pair of outlet ports 3. The inlet passes through the body so that when the valves are stacked as illustrated in FIG. 1, adjacent pairs of inlet ports on adjacent valves are in alignment, so that hydraulic fluid can pass into and form all three valves. The extra inlet ports of the valve 2B are closed with plugs 4 (FIG. 1). Each valve contains a spool 17 that can be displaced along the valve body selectively to open or close communication between the inlet and the outlet.

In the valves 2A, the spool 17 is biased to a valve closed condition, in which the communication between the inlet and the outlet is cut off, by a coil spring 16 acting on the bottom of the spool and held in place by a plug 4' threaded into the bottom of the valve body. To move the spool to a valve open condition, in which communication is established between the inlet and outlet, a solenoid 1 is actuated, forcing the spool along the valve body against the force of spring 16. The valve 2B is similarly constructed, but in this case the coil spring 16 is omitted and a second solenoid 1 is mounted on the valve body so that the spool 17 may be positively displaced from either the open or the closed condition to the other, with neither condition being a "default" condition.

The inlet ports of the valve 2A on the left hand side of the sides viewed in FIG. 1 are connected to respective hydraulic lines 5 which are in turn connected to quick release hydraulic couplers 6 that mount in the outlet ports of the single outlet hydraulic system. The two outlet ports are thus coupled to the inlet port of all three valves and each valve can be actuated to open aand close communication between its outlet and that of the single system. The two way valves provide for supply and return flow, which may be reversible depending on the control of the single outlet system.

Figure 2:
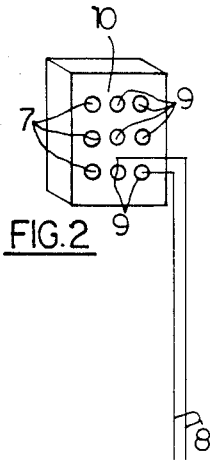
FIG. 2 is an isometric representation of a control module.

FIG. 2 of the accompanying drawing illustrates a control module 10 with a series of on-off switches 9. The switches are all connected to a power supply (not illustrated) and each active switch is connected to a respective valve actuator solenoid 1 by electric circuits 8. The illustrated control module has a series of six switches that can be used for a system with up to six solenoid actuators 1 for the three valves 2A, 2A and 2B. The control module 10 also has three indicator lights 7 that are operatively connected to the switches 9 so that each light will be illuminated when the respective one of the valves is open. The control module is intended to be mounted at an operator's station. In the case of a tractor, this would be in the cab next to the hydraulic controls.

Figure 3:
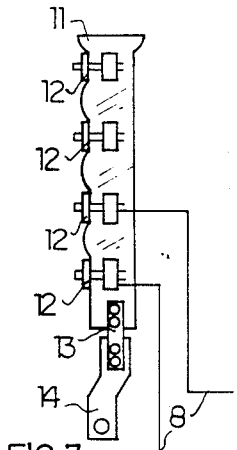
FIG. 3 is a side elevaton of a control handle sectioned to show the internal structure.

An alternate control module is illustrated in FIG. 3. This module is a control handle 11 with a series of four switches spaced along the handle. The switches are normally open and close when pressed. Each switch is connected to an electric supply (not illustrated) and to a respective one of the solenoids 1 by a circuit 8 for actuating the respective valve. The control handle is equipped with a mounting bracket 13, 14 for mounting the handle on an existing hydraulic control lever (not illustrated) of the original equipment single outlet system. This means that the operator can control both the selection of outlets and the flow to those outlets with a single hand.

The use of quick release couplings connecting the valves into the existing hydraulic system allows the system to be transported readily from one hydraulic power unit to another simply by uncoupling the hose connections and the wiring harness.

While one embodiment of the present invention has been described in the foregoing, it is to be understood that the other embodiments are responsible within the scope of the present invention. The invention is to be considered limited solely by the scope of the appended claims.

I claim:

1. A kit for converting to a plural outlet system a single outlet hydraulic system having a single hydraulic system outlet including two hydraulic system outlet ports, means for supplying hydraulic fluid under pressure to the hydraulic system outlet and means including a manually operable lever for varying the hydraulic fluid supply to the hydraulic system outlet, said kit comprising:

a plurality of two-way, two-position valves, each having a valve inlet comprising two valve inlet ports, a valve outlet comprising two valve outtlet ports, valving means operatively connected between the inlet and outlet and having valve opening and valve closed conditions, respectively opening and closing communication between the outlet and the inlet, and actuator means operativdely associated with the valving means for selectively actuating the valving means into the valve open and valve closed conditions each actuator means being independent of each other actuator means;

valve inlet coupling means coupling the valve inlets in parallel for fluid communication therebetween;

means for connecting the coupled valve inlets to the hydraulic system outlets;

a control handle including a hand grip and a plurality of manually operable control means spaced therealong for engagement by respective fingers of an operator's hand;

means for mounting the control handle on the manually operable lever of the hydraulic system; and control circuit means connecting each valve actuator means to a respective manually operable control means for selective operation of the actuator means in response to operation of the control.

2. A kit according to claim 1 wherein the valves are secured together in a unit.

3. A kit according to claim 2 wherein each valve inlet comprises at least one pair of inlet ports for supply and return flow.

4. A kit according to claim 3 wherein each valve inlet comprises a second pair of inlet ports and wherein the valves are stacked with adjacent valves having aligned pairs of inlet ports.

5. A kit according to claim 4 wherein each valve is a spool valve, the valving means being a valve spool.

6. A kit according to claim 5 wherein the valve actuator means comprise solenoid actuators.

7. A kit according to claim 6 wherein at least one of the valves further comprises a spring return means operatively associated with the valving means, to bias the valving means toward the valve closed condition, and the solenoid actuator is operatively associated with the valving means to actuate the valving means to the valve open condition.

8. A kit according to claim 1 including quick release coupling means for coupling the inlets to the single outlet system.

* * * * *